US010328300B2

(12) United States Patent
Ko

(10) Patent No.: US 10,328,300 B2
(45) Date of Patent: Jun. 25, 2019

(54) WEARABLE MUSCULAR STRENGTH ASSISTING APPARATUS

(71) Applicant: HYUNDAI MOTOR COMPANY, Seoul (KR)

(72) Inventor: Hun Keon Ko, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 640 days.

(21) Appl. No.: 14/992,754

(22) Filed: Jan. 11, 2016

(65) Prior Publication Data

US 2017/0100626 A1 Apr. 13, 2017

(30) Foreign Application Priority Data

Oct. 12, 2015 (KR) ..... 10-2015-0141940

(51) Int. Cl.

| | |
|---|---|
| ***A63B 21/00*** | (2006.01) |
| ***A63B 21/22*** | (2006.01) |
| ***A63B 23/04*** | (2006.01) |
| ***A63B 24/00*** | (2006.01) |
| ***A63B 21/005*** | (2006.01) |
| ***A63B 23/035*** | (2006.01) |

(52) U.S. Cl.

CPC ..... *A63B 21/22* (2013.01); *A63B 21/153* (2013.01); *A63B 21/154* (2013.01); *A63B 21/4007* (2015.10); *A63B 21/4009* (2015.10); *A63B 21/4011* (2015.10); *A63B 21/4025* (2015.10); *A63B 21/4047* (2015.10); *A63B 23/03533* (2013.01); *A63B 23/0405* (2013.01); *A63B 23/0482* (2013.01); *A63B 24/0087* (2013.01); *A63B 21/0058* (2013.01); *A63B 21/00181* (2013.01); *A63B 2024/0093* (2013.01); *A63B 2220/51* (2013.01)

(58) Field of Classification Search

None

See application file for complete search history.

(56) References Cited

U.S. PATENT DOCUMENTS

| | | | | |
|---|---|---|---|---|
| 9,943,460 | B2 * | 4/2018 | Roh | A61H 3/00 |
| 9,949,851 | B2 * | 4/2018 | Lee | A61F 2/70 |

FOREIGN PATENT DOCUMENTS

| | | | |
|---|---|---|---|
| JP | 2003-265548 | A | 9/2003 |
| JP | 2013-173190 | A | 9/2013 |
| JP | 2014-054273 | A | 3/2014 |
| JP | 2014-128724 | A | 7/2014 |
| KR | 10-1142240 | B1 | 5/2012 |
| KR | 10-1510019 | B1 | 4/2015 |

OTHER PUBLICATIONS

Korean Office Action dated Mar. 1, 2017 issued in Korean patent application No. 10-2015-0141940.

* cited by examiner

*Primary Examiner* — Sundhara M Ganesan

(74) *Attorney, Agent, or Firm* — Morgan Lewis & Bockius LLP

(57) ABSTRACT

A wearable muscular strength assisting apparatus includes a base part for supporting a rear surface of a wearer, a leg part rotatably coupled to the base part and connected to a lower part of a body of the wearer, a wire part coupled to each of the base part and the leg part and a driving part provided in at least one of the base part and the leg part, coupled to the wire part, and driven to pull or release the wire part depending on a control to provide assist force to waist muscular strength of the wearer.

10 Claims, 3 Drawing Sheets

[FIG. 1]
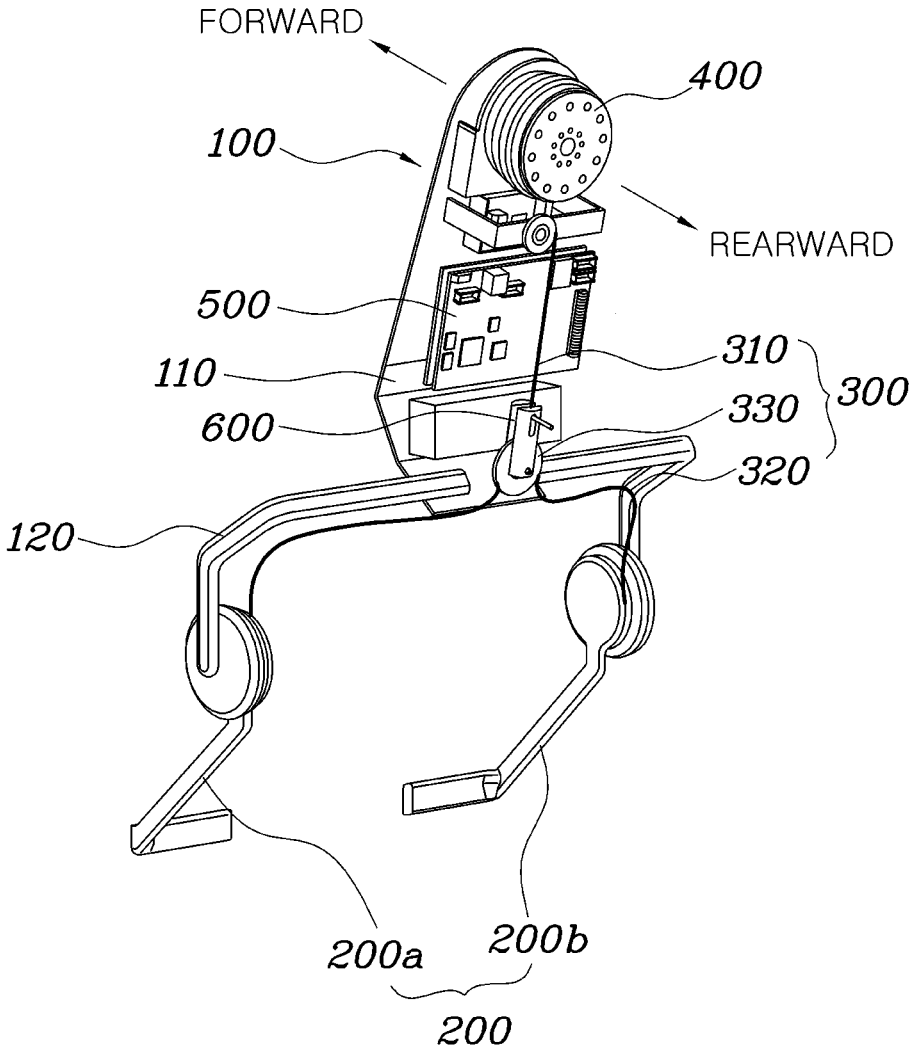

[FIG. 2]
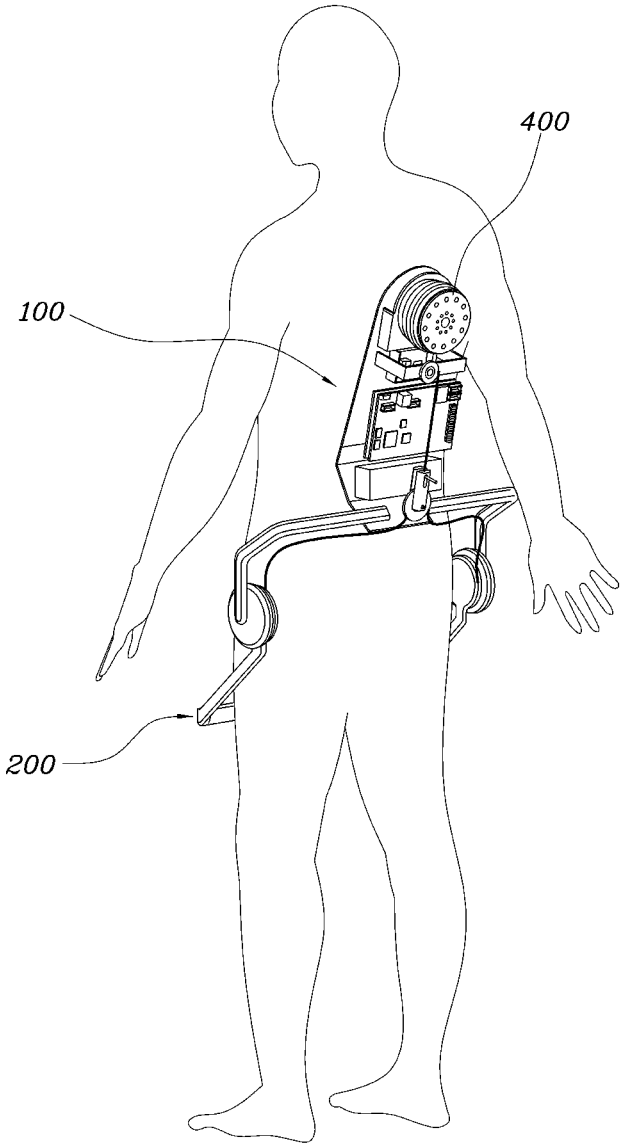

[FIG. 3]
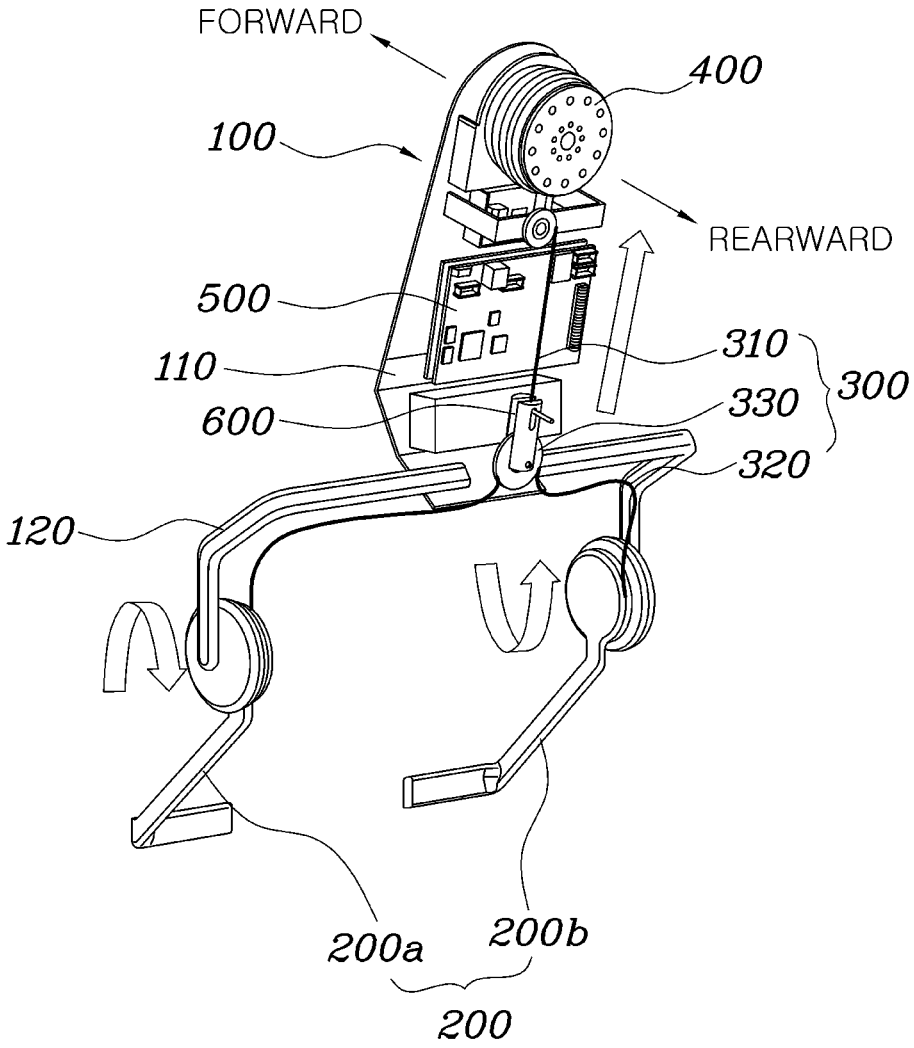

WEARABLE MUSCULAR STRENGTH ASSISTING APPARATUS

CROSS REFERENCE TO RELATED APPLICATION

The present application claims the benefit of priority to Korean Patent Application No. 10-2015-0141940, filed Oct. 12, 2015 with the Korean Intellectual Property Office, the entire contents of which are incorporated herein for all purposes by this reference.

TECHNICAL FIELD

The present disclosure relates to a wearable muscular strength assisting apparatus, and more particularly, to a wearable muscular strength assisting apparatus capable of supporting back and waist muscular strength of a wearer.

BACKGROUND

Although many kinds of working equipment has been developed, work that should be directly performed by a person or work where efficiency is increased when the work is performed by a person is still present in various industrial fields.

However, in such work, a case in which physical requirements exceed physical limitations of a person may occur. In this case, a large number of persons may perform the work together or a small number of persons may perform the work in excess of their abilities, such that the efficiency of the work is decreased and a risk of injury to a worker's body increases.

In order to solve this problem, a wearable robot that may be directly worn by a worker and add assist force to a movement of the worker has been developed. In the case of a wearable robot according to the related art, the whole body of the worker is enclosed with a metal for the purpose of robustness and operational stability of the robot, such that a load is applied, totally or partially, to the robot instead of to the worker.

However, in the wearable robot having the form described above, a plurality of metallic links are used, which cause an increase in worker fatigue due to an increase in weight or work instability due to a limited degree of freedom of motion. Further, a size of the robot may be increased in order to allow the load to be applied to the robot instead of to the worker.

The contents described as the related art have been provided only for assisting in the understanding for the background of the present disclosure and should not be considered as corresponding to the related art known to those skilled in the art.

SUMMARY OF THE DISCLOSURE

An object of the present disclosure is to provide a wearable muscular strength assisting apparatus capable of providing assist force for waist movement of a wearer and having a simplified structure by removing an unnecessary link structure.

According to an exemplary embodiment of the present disclosure, there is provided a wearable muscular strength assisting apparatus including: a base part supporting a rear surface of a wearer; a leg part rotatably coupled to the base part and connected to a lower part of a body of the wearer; a wire part coupled to each of the base part and the leg part; and a driving part provided in at least any one of the base part and the leg part, coupled to the wire part, and driven to pull or release the wire part depending on a control to provide assist force to waist muscular strength of the wearer.

The wearable muscular strength assisting apparatus may further include a sensing part detecting a load applied to the wire part and a control part controlling the driving part to maintain a set load in the wire part depending on a value detected in the sensing part.

The base part may include a supporting plate having a predetermined length so as to support a back and a waist of the wearer, and a portion of the supporting plate corresponding to the waist of the wearer may be bent so as to contact the waist along a curvature of the waist.

One end portion of the leg part may contact a thigh in front of the wearer, the other end portion of the leg part may be rotatably coupled to the base part, and the one end portion of the leg part may rotate so as to press the thigh at the time of pulling the wire part.

A pair of leg parts may be provided, the base part may include a pair of extenders extended toward both sides of the wearer and having end portions bent toward the leg part, and the bent end portions of the extenders may be hinge-coupled to the leg parts.

A pair of leg parts may be provided, and the wire part may include a leg part side wire having both end portions each coupled to the pair of leg parts and a driving part side wire connecting a portion between both end portions of the leg part side wire and the driving part to each other.

The wire part may further include a pulley hung on and coupled to the leg part side wire, the pulley being coupled to an end portion of the driving part side wire.

A sensing part may be provided between an end portion of the driving part side wire and the pulley so as to detect a load applied to the driving part side wire.

According to another exemplary embodiment of the present disclosure, there is provided a wearable muscular strength assisting tool including: a driving part pulling or releasing a wire part connecting an upper part and a lower part of a body of a wearer to each other at the time of bending or stretching the upper part to provide assist force to relative movement of the upper part and the lower part.

The wearable muscular strength assisting tool may further include a sensing part detecting tension of the wire part and a control part controlling the driving part so that the wire part maintains set tension.

BRIEF DESCRIPTION OF THE DRAWINGS

FIG. 1 is a view illustrating a configuration of a wearable muscular strength assisting apparatus according to an exemplary embodiment of the present disclosure.

FIG. 2 is a view illustrating a form at a time of wearing the wearable muscular strength assisting apparatus according to an exemplary embodiment of the present disclosure.

FIG. 3 is a view illustrating an operation form at a time of walking of a wearer of the wearable muscular strength assisting apparatus according to an exemplary embodiment of the present disclosure.

DESCRIPTION OF THE EXEMPLARY EMBODIMENTS

Hereinafter, a wearable muscular strength assisting apparatus according to an exemplary embodiment of the present disclosure will be described with reference to the accompanying drawings.

FIG. 1 is a view illustrating a configuration of a wearable muscular strength assisting apparatus according to an exemplary embodiment of the present disclosure, and FIG. 2 is a view illustrating a form at a time of wearing the wearable muscular strength assisting apparatus according to an exemplary embodiment of the present disclosure. The wearable muscular strength assisting apparatus according to an exemplary embodiment of the present disclosure may be configured to include a base part 100 supporting a rear surface of a wearer, a leg part 200 rotatably coupled to the base part 100 and connected to a lower part of a body of the wearer, a wire part 300 coupled to each of the base part 100 and the leg part 200, and a driving part 400 provided in at least one of the base part 100 and the leg part 200, coupled to the wire part 300, and driven to pull or release the wire part 300 depending on a control to provide assist force to waist muscular strength of the wearer.

In addition, the wearable muscular strength assisting apparatus according to an exemplary embodiment of the present disclosure may further include a sensing part 600 detecting a load applied to the wire part 300 and a control part 500 controlling the driving part 400 to maintain a set load in the wire part 300 depending on a value detected in the sensing part 600.

In detail, the base part 100 may include a supporting plate 110 having a predetermined length so as to support a back and a waist of the wearer, and a portion of the supporting plate 110 corresponding to the waist of the wearer may be bent so as to contact the waist along a curvature of the waist.

It is preferable that the supporting plate 110 may be formed to have a predetermined length along a backbone of the wearer and may directly or indirectly contact the back and the waist of the wearer to support the back and the waist of the wearer. A cushion coupled to the supporting plate 110, or the like, may be further provided between the supporting plate 110 and the rear surface of the wearer.

In addition, the supporting plate 110 may be fixed to an upper part of the body of the wearer using a bending means such as strap, a belt, or the like, but is not limited thereto. That is, the supporting plate 110 may be fixed to the upper part of the body of the wearer by various coupling methods of fixing the supporting plate 110 to the upper part of the body of the wearer. Alternatively, the rear surface of the wearer may be supported in a pressing scheme depending on pulling of the wire part 300 without using any coupling apparatus.

The portion of the supporting plate 110 corresponding to the waist of the wearer may be bent so as to contact the waist along the curvature of the waist, such that the supporting plate 110 may robustly support the waist of the wearer and an area contacting the rear surface of the wearer may be increased to improve a rear surface supporting effect.

Meanwhile, the base part 100 may further include a pair of extenders 120 extended toward both sides of the wearer and having end portions bent toward the leg part 200. The bent end portions of the extenders 120 may be hinge-coupled to the leg part 200. It is preferable that one end portion of each of the extenders 120 are coupled to and supported by the supporting plate 110 and the other end portions thereof are extended to the left and the right of the wearer and then bent to thereby be hinge-coupled to the leg part 200.

The extenders 120 may be configured in various forms such as a bar form, a plate form, a frame form, and the like, and a coupling point between the leg part 200 and the base part 100 may be variously set due to the extenders 120. For example, a coupling position between the leg part 200 and the base part 100 may be set so that the center of rotation of the leg part 200 coincides with the center of rotation of bending of a thigh and the waist of the wearer. Alternatively, hinge-coupling points may be formed at various points allowing rotation to be freely performed when the waist is bent.

Meanwhile, it is preferable that one end portion of the leg part 200 contacts the thigh in front of the wearer, the other end portion of the leg part 200 is rotatably coupled to the extenders 120, and the one end portion of the leg part 200 rotates so as to press the thigh at the time of pulling the wire part 300. In addition, it is preferable that a pair of leg parts 200 may be provided and contact a left thigh and a right thigh of the wearer, respectively, and the other end portions of the pair of leg parts 200 may be rotatably coupled to the pair of extenders 120, respectively. The leg parts 200 may not only be coupled to the thighs, but may also be coupled to various positions of the lower part of the body of the wearer by various coupling means.

Although the leg parts 200 may be bent and coupled to the thighs of the wearer to thereby move integrally with the thighs, similar to the supporting plate 110, one end portion of each of the pair of leg parts 200 may be bent in a direction in which they face each other and contact the thighs, such that the leg parts 200 may serve as a support so that the base part 100 may support the rear surface of the wearer.

In addition, the leg part 200 may have various structures such as a bar structure, a plate structure, a frame structure, and the like, and it is preferable that the wire part 300 may apply a rearward pulling force to the leg parts 200 so that the leg parts 200 rotate rearward with respect to the center of hinge-rotation to press the thighs when the wire part 300 is pulled.

Meanwhile, the wire part 300 may further include a leg part side wire 320 having both end portions each coupled to the pair of leg parts 200, and a driving part side wire 310 connecting a portion between both end portions of the leg part side wire 320 and the driving part 400 to each other. In addition, the wire part 300 may further include a pulley 330 hung on and coupled to the leg part side wire 320. The pulley 330 may be coupled to an end portion of the driving part side wire 310.

Both end portions of the leg part side wire 320 may be coupled to the pair of leg parts 200, respectively, to enable the wearer to walk, one end portion of the driving part side wire 310 may be connected to the leg part side wire 320, and the other end portion of the driving part side wire 310 may be connected to the driving part 400. In detail, the leg part side wire 320 and the driving part side wire 310 may be connected to each other through the pulley 330 disposed therebetween, such that a pulling force of the driving part side wire 310 may be transferred to the leg parts 200, and the leg part side wire 320 may also independently move, such that both of waist support and walking of the wearer may be possible.

Meanwhile, the sensing part 600 may be provided between an end portion of the driving part side wire 310 and the pulley 330 so as to detect a load applied to the driving part side wire 310.

As the sensing part 600, a load cell that may be pressed at the time of generation of pulling of the driving part side wire 310 to detect an increase in tension may be used. Alternatively, a strain gauge may be used to detect tension of the driving part side wire 310. In the case of using the load cell, one surface of the load cell may be supported by the leg part side wire 320, the other surface of the load cell may contact the driving part side wire 310 to thereby be supported by the driving part side wire 310, and the load cell may be pulled in one surface side direction thereof at the time of pulling the driving part side wire 310, such that the load cell may be pressed and an increase in tension may be detected. This is only an example: a connection structure using the load cell may be variously set, and various types of tension detecting means may be used in addition to the load cell or the strain gauge.

In addition, the driving part 400 may be a motor, and may be driven to wind or unwind the driving part side wire 310 by a control of the control part 500. In addition to the motor, various means that may pull or release the driving part side wire 310 may be used as the driving part 400. For example, a driving means having a cylinder form such as a hydraulic cylinder may be used to pull or release the driving part side wire 310 depending on compression or extension. Various examples may be applied to the driving part 400.

Next, an operation process of the wearable muscular strength assisting apparatus according to an exemplary embodiment of the present disclosure will be described with reference to the above-mentioned components. In the case in which the wearer bends his/her waist, rearward rotation of the leg parts 200 may be stopped by the thighs, such that tensile force is generated in the driving part side wire 310. This may increase a tension of the driving part side wire 310, and the sensing part 600 may sense a tension value and transmit the sensed tension value to the control part 500. The control part 500 may detect an increase in the tension of the driving part side wire 310, and may control the driving part 400 to release the driving part side wire 310 so that the tension of the driving part side wire 310 is always maintained as a set tension value.

On the other hand, in the case in which the wearer stretches his/her waist, the tension of the driving part side wire 310 may become loose, and the driving part 400 may wind the driving part side wire 310 so as to increase the decreased tension. The driving part side wire 310 may be wound to thereby be pulled, such that the pulley 330 moves toward the driving part 400, and the leg part side wire 320 hung on the pulley 330 is pulled toward the driving part 400, which rotates the respective leg parts 200 rearward. When the rotation of the leg parts 200 is stopped by the thighs while the leg parts 200 being rotated rearward, the base part 100 may apply a forward load to the rear surface of the wearer by a reaction force to the stop of the rotation, and the tension may be maintained as a set tension value, such that the base part 100 supports the rear surface of the wearer. Therefore, assist force may be provided with respect to relative movement of the upper part and the lower part of the body.

Meanwhile, FIG. 3 is a view illustrating an operation form at a time of walking of a wearer of the wearable muscular strength assisting apparatus according to an exemplary embodiment of the present disclosure. Since the leg part side wires 320 may be connected to each other and may be connected to the driving part side wire 310 through the pulley 330, the wearer may walk in a state in which the tension value is maintained regardless of an operation of the driving part side wire 310 pulling the leg part side wires 320. For example, in the case in which the wearer moves a left leg forward, a left leg part 200*a* connected to the left leg may also rotate forward, and one end portion of the leg part side wire 320 connected to the left leg part 200*a* may pull the other end portion thereof. This pulling force may be transferred to a right leg part 200*b*, and the right leg part 200*b* may receive rearward rotational force to provide rearward pressing force to a right leg. Therefore, the wearer may walk in a state in which the tension is maintained by the driving part side wire 310, such that effects such as free movement of the wearer and provision of the assist force to the waist of the wearer may be provided.

In the wearable muscular strength assisting apparatus according to an exemplary embodiment of the present disclosure having the structure as described above, the assist force is provided in bending or stretching the waist of the wearer, such that a burden applied to the waist of the wearer may be alleviated and generation of damage to the waist due to impact may be prevented.

In addition, the wearable muscular strength assisting apparatus according to an exemplary embodiment of the present disclosure may have a structure simpler than that of a robot enclosing the whole body of the wearer, and the number of components may be decreased such that a weight may be decreased and a load burden applied to the wearer may be alleviated, thereby making it possible to generate an effect such as a decrease in worker fatigue.

In addition, since the wearer may freely walk, a work difficulty may be eased.

Although the present disclosure has been shown and described with respect to specific exemplary embodiments, it will be obvious to those skilled in the art that the present disclosure may be variously modified and altered without departing from the spirit and scope of the present disclosure as defined by the following claims.

What is claimed is:

1. A wearable muscular strength assisting apparatus comprising:

a base part for supporting a rear surface of a wearer;

a leg part rotatably coupled to the base part and connected to a lower part of a body of the wearer;

a wire part coupled to each of the base part and the leg part; and a driving part provided in at least one of the base part and the leg part, coupled to the wire part, and driven to pull or release the wire part depending on a control to provide assist force to waist muscular strength of the wearer, wherein the wire part includes a leg part side wire having both end portions each coupled to a pair of leg parts and a driving part side wire connecting a portion between both end portions of the leg part side wire and the driving part to each other.

2. The wearable muscular strength assisting apparatus of claim 1, further comprising a sensing part for detecting a load applied to the wire part and a control part for controlling the driving part to maintain a set load in the wire part depending on a value detected in the sensing part.

3. The wearable muscular strength assisting apparatus of claim 1, wherein the base part includes a supporting plate having a predetermined length so as to support a back and a waist of the wearer, and a portion of the supporting plate corresponding to the waist of the wearer is bent so as to contact the waist along a curvature of the waist.

4. The wearable muscular strength assisting apparatus of claim 1, wherein one end portion of the leg part contacts a thigh in front of the wearer, the other end portion of the leg part is rotatably coupled to the base part, and the one end portion of the leg part rotates so as to press the thigh at the time of pulling the wire part.

5. The wearable muscular strength assisting apparatus of claim 1, wherein the base part includes a pair of extenders extended toward both sides of the wearer and having end portions bent toward the pair of leg parts, and the bent end portions of the extenders are hinge-coupled to the pair of leg parts.

6. The wearable muscular strength assisting apparatus of claim 1, wherein the wire part further includes a pulley hung on and coupled to the leg part side wire, the pulley being coupled to an end portion of the driving part side wire.

7. The wearable muscular strength assisting apparatus of claim 1, wherein a sensing part is provided between an end portion of the driving part side wire and a pulley so as to detect a load applied to the driving part side wire.

8. A wearable muscular strength assisting tool comprising:

a driving part pulling or releasing a wire part connecting an upper part and a lower part of a body of a wearer to each other at a time of bending or stretching the upper part to provide assist force during relative movement of the upper part and the lower part, wherein the wire part includes a leg part side wire having both end portions each coupled to a pair of leg parts and a driving part side wire connecting a portion between both end portions of the leg part side wire and the driving part to each other.

9. The wearable muscular strength assisting tool of claim 8, further comprising a sensing part for detecting a tension of the wire part and a control part for controlling the driving part so that the wire part maintains a set tension.

10. A wearable muscular strength assisting apparatus comprising:

a base part for supporting a rear surface of a wearer;

a pair of leg parts rotatably coupled to the base part and connected to a left lower part and a right lower part of a body of the wearer;

a leg part side wire having both end portions each coupled to the pair of leg parts;

a driving part side wire having one end portion coupled between both end portions of the leg part side wire;

a driving part coupled to an other end portion of the driving part side wire and driven to pull or release the driving part side wire depending on a control to provide assist force to waist muscular strength of the wearer;

a sensing part for detecting a tension of the driving part side wire; and a control part for controlling the driving part so that the driving part side wire maintains set tension.

* * * * *